US005884769A

United States Patent [19]

Anderson

[11] Patent Number: 5,884,769

[45] Date of Patent: Mar. 23, 1999

[54] PARTICULATE MATERIAL PROCESSING TRAY

[75] Inventor: George E. Anderson, Champlin, Minn.

[73] Assignee: Crown Iron Works Company, Minneapolis, Minn.

[21] Appl. No.: 974,613

[22] Filed: Nov. 19, 1997

[51] Int. Cl.[6] ..... B65D 25/04

[52] U.S. Cl. ..... 206/557; 220/505

[58] Field of Search ..... 206/557, 562; 220/571, 572, 503, 505, DIG. 6

[56] References Cited

U.S. PATENT DOCUMENTS

| | | | |
|---|---|---|---|
| 4,880,156 | 11/1989 | Wallet | 220/DIG. 6 |
| 5,031,796 | 7/1991 | Schafer et al. | 220/571 |
| 5,323,903 | 6/1994 | Bush et al. | 220/571 |
| 5,577,539 | 11/1996 | Shaw et al. | 220/571 |
| 5,628,405 | 5/1997 | Price et al. | 220/571 |
| 5,662,237 | 9/1997 | Cain | 220/DIG. 6 |

FOREIGN PATENT DOCUMENTS

| | | | |
|---|---|---|---|
| 935405 | 10/1973 | Canada | 220/DIG. 6 |

*Primary Examiner*—Joseph M. Moy

*Attorney, Agent, or Firm*—Nawrocki, Rooney & Sivertson, P.A.

[57] ABSTRACT

A tray for supporting particulate material in an apparatus for processing. The tray includes an upper plate which has pluralities of associated groupings of first apertures formed therein. The tray also includes a lower plate which has a plurality of second apertures formed therein. Each of said second apertures corresponds with, and generally underlies, one of the associated groupings of first apertures formed in the upper plate. Further, the tray also includes a plurality of staybolts which extend between the upper and lower plates. Each staybolt has a first end which circumscribes an associated grouping of first apertures and defines a shoulder in engagement with a lower surface of the upper plate. Each staybolt also has a second end received through one of the second apertures. Each staybolt also has a wall defining a conduit passing therethrough from the first to the second end thereof. The conduit serves to direct fluid having passed through a corresponding second aperture, through the corresponding associated grouping of first apertures. Spacing and positioning of first apertures in one associated grouping relative to an adjacent grouping of first apertures is such that distribution of all of the first apertures is generally uniform throughout the upper plate.

13 Claims, 3 Drawing Sheets

PARTICULATE MATERIAL PROCESSING TRAY

TECHNICAL FIELD

The present invention deals broadly with the treating of particulate materials having viscous fluids entrained therein. More specifically, however, the invention deals with apparatus having vertically spaced compartments in which particulate material, laden with a viscous material, is disposed for treatment. The specific focus of the invention is a tray, defining a floor of such a compartment, on which the particulate material is generally supported, and through which a fluid (typically, a gas) is passed to process the material.

BACKGROUND OF THE INVENTION

Because of the use of various solvents in processes for treating particulate materials, and particularly granular materials, extraction apparatuses are used to separate an oil or solvent from the granular materials. This is accomplished in various ways. In one type of apparatus, granular materials are subjected to a bath, and the bath draws oil from the grains to form a miscella. The miscella can then be separated from the granular materials by a screen or other means. In any case, a large fraction of the solvent and miscella is extracted and transferred to a location away from the granular materials. In the type of process described, the grains might go through a number of baths and would eventually be dried prior to being transferred for further processing, storage, or shipment.

In another type of process, an apparatus having vertically stacked plenums in which the granular materials are disposed is employed. Each stage has a porous floor through which a fluid is passed to contact a bed of the grain disposed on the floor of the plenum. In such operations, a typical depth of granular material is 24 inches. It will be understood, however, that the depth of granular material may, in fact, range anywhere between 16 inches and 48 inches.

In this type of process each floor can be defined by generally parallel, upper and lower plates. A chamber can, thereby, be defined between the plates, heated air or steam, typically, being introduced into the chamber to heat the plates and, indirectly, the granular material while it is disposed on the floor of the plenum. The floor, however, employs staybolts which function to maintain the distance between the upper and lower plates. Further, the staybolts define conduits passing upwardly through a floor from one plenum into the next. A staybolt defines a conduit which passes through the chamber between the upper and lower plates, and the conduit is isolated from the chamber. Heated fluid (i.e., air or steam) can be injected into the lowest plenum to rise from plenum to plenum and pass through and treat the granular materials in each plenum as it passes therethrough.

In the prior art, the staybolts are affixed to the upper and lower plates in various ways. Typically, the length of a staybolt extends through the full dimension between the upper surface of the upper plate and the lower surface of the lower plate. In such a construction, heavy welds are employed (that is, the weld volume is significant). This not only results in a greater cost in manufacturing, but it can also result in shrinkage and distortion of the plates, as well as the possibility of leakage upwardly through a defective weld joint. Because welding is necessary at a location which can result in buildup of the weld material upwardly from the upper surface of the upper plate, expensive grinding can be necessary to make the upper surface of the upper plate substantially planar.

Various other attempts have been made to improve the manner in which staybolts are mounted. For example, an aperture formed in the upper plate has been made considerably smaller than the coaxial aperture in the lower plate. The staybolt is given a smaller axial dimension so that the upper axial end of the staybolt abuts a lower surface of the upper plate at a location radially outward from the periphery of the aperture in the upper plate. This attempted solution, however, can also presents problems. In this solution, there can be, and frequently is, difficulty in accessing the upper weld. If the staybolt is of a sufficient diameter to afford good access to the weld, then the staybolt is of such a large diameter that several apertures or holes must be provided in the top plate so as to enable a desired rate of fluid flow. In prior art structures employing this solution, the result has been the provision of a cluster of holes at each staybolt with relatively wide spacing of the staybolts in their respective clusters. In consequence, the pattern of gas flow contacting and treating the granular material above the tray is significantly non-uniform. This results in lower efficiency of operation of the apparatus.

It has been found that a phenomenon which typically results where there is proper and efficient functioning of a desolventizer apparatus is the generation of a roughly spherical-shaped fluid void in the particulate material disposed on the upper surface of the upper plate in the immediate proximity of an aperture through which processing fluid escapes upwardly. Similar sized and shaped voids are typically created above each aperture. Each void, where the depth of the granular or particulate material is approximately 24 inches, typically has a real dimension radius of between ¾ and 1 inch. Such a void is created by the pressure and upward velocity of the processing fluid as it escapes through an upper egress port of a staybolt and into the surrounding particulate material. It is important, however, that adjacent apertures through which the processing fluid passes be on centers of at least two times the ¾ to 1 inch radius dimension so that fluid voids generated above adjacent apertures do not interfere and thereby decrease the efficiency of the processing.

Furthermore, it has been found that the pattern of apertures passing through the chamber via staybolts should be substantially uniform across the top surface of the tray. It has been discovered that, if the apertures are clustered, processing fluid escaping upwardly through a cluster of apertures is more likely to combine and form a large diameter channel centered on the cluster of apertures. Such a phenomenon enables the fluid to escape from the bed without substantial contact with the particulate material.

A further drawback of this phenomenon is that the large diameter channel of escaping fluid will tend to define a geyser effect, and granular material will be spewed into the space above the bed of material. The geyser may rise to a sufficient height to entrain particulate material in the flow of fluid as it is drawn from the machine into a final vent system. When this occurs, the granular material may contaminate the vent system and cause problems in operation.

It is to these problems of the prior art and desirable features that the present invention is directed. It is an improved tray construction which accomplishes many of the mandates and solves many of the problems of the prior art.

DETAILED DESCRIPTION OF THE INVENTION

Figure 2:
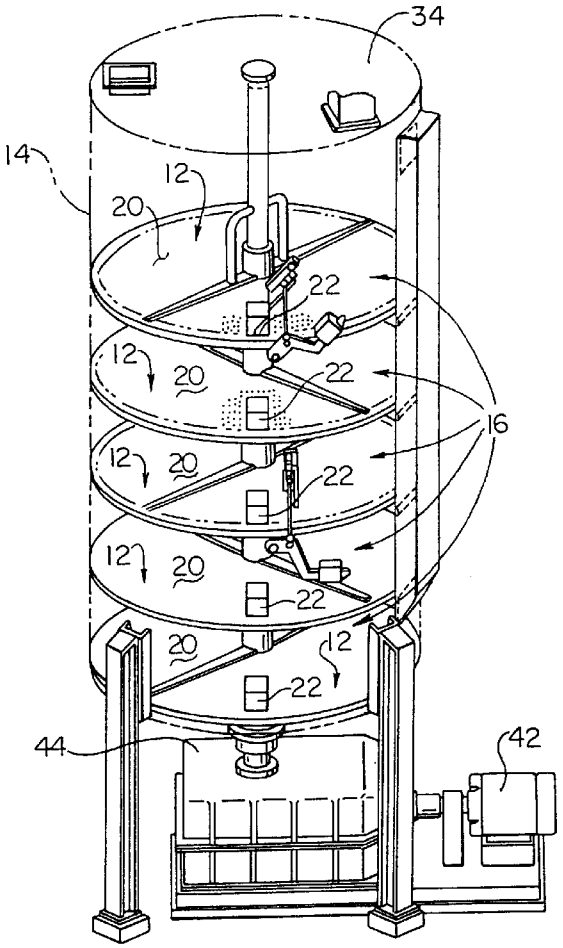
FIG. 2 is a perspective view of the desolventizer of FIG. 1, the outer wall being shown in phantom.
Figure 1:
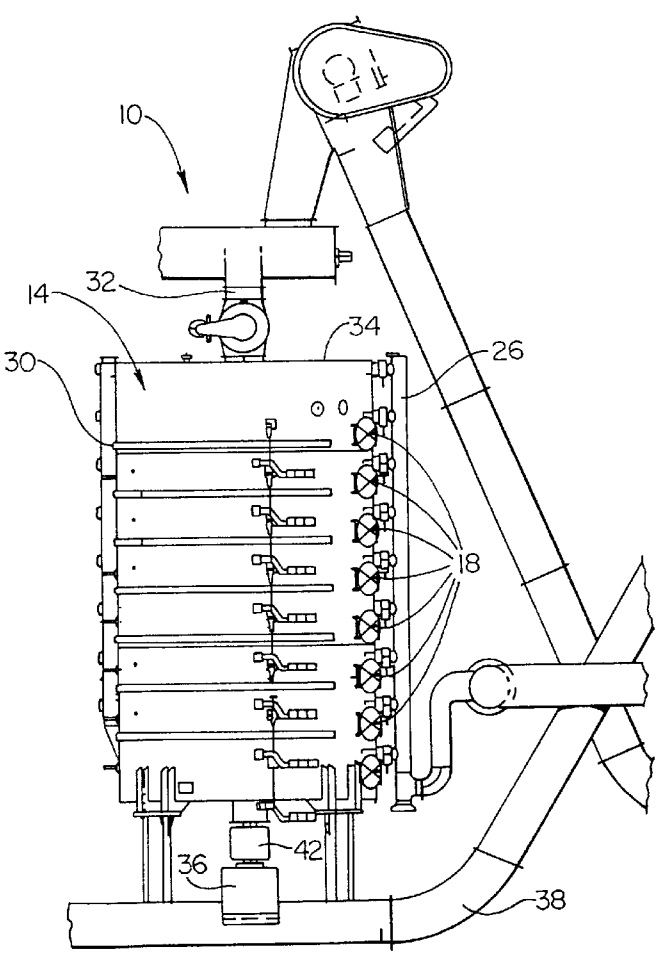
FIG. 1 is a side elevational view of a desolventizer employing the tray construction of the present invention.

Referring now to the drawings wherein like reference numerals denote like elements throughout the several views, FIG. 1 illustrates a particulate material processing apparatus 10 which employs a tray 12 in accordance with the present invention. The particular apparatus illustrated is a device for desolventizing granular material having entrained therein a solvent such as hexane. The desolventizer includes a housing 14 which, as best seen in FIG. 2, is cylindrical and disposed with its longitudinal axis oriented substantially vertical.

The housing 14 is compartmentalized along such a vertical axis to define a plurality of vertically-spaced plenums 16. Each plenum 16 has an access port 18 on the outside of the housing 14, and a floor 20 of each plenum 16 is defined by a tray 12 in accordance with the present invention. If desired, each tray 12 can be provided with a gate 22, swingable downward, through which particulate material seated on the tray 12 can be deposited into the next lower plenum. A control 24, external to the housing 14, is provided for operating each gate 22.

A manifold 26 is mounted on one side of the housing 14. The manifold 26, in turn, communicates with each chamber 28 defined within a corresponding one of the plurality of trays 12 to introduce a hot fluid into the various chambers 28. The housing 14 is provided with a vent 30, illustrated in FIG. 1, on a side thereof opposite the side of the manifold. The fluid can be vented from the chambers 28 through this apparatus.

Processing fluid (e.g., heated air) enters a lowermost plenum 16 and passes upwardly through each tray 12 through an aperture arrangement as will be discussed hereinafter. This is in a counter-current flow to downwardly-passing particulate material deposited into the apparatus housing 14 through an inlet 32 proximate the top 34 thereof. As will be able to be seen in view of this disclosure, the particulate material passes downwardly through apertures formed in each tray 12, and particulate material on any particulate tray 12 can be released more quickly and deposited onto the floor of the next lower plenum through a gate 22, if desired. As the heated air passes upwardly through a tray, interaction of the air with the particulate material effects desolventizing.

Particulate material passed downwardly through the various plenums 16 accumulates in the lowest plenum. From that location, it is evacuated from the housing 14 by means of a valving mechanism 36 and deposited on a conveyor 38. The conveyor 38, in turn, transports the particulate material, after processing has been performed, to a location for subsequent disposition.

FIG. 2 illustrates a series of vertically-spaced trays 12. As can be seen in that figure, if desired, a tray 12 can be provided with a sweep arm 40 to agitate the particulate material and facilitate processing. FIG. 2 illustrates trays 12 having sweep arms 40 which are angularly spaced at 90° relative to sweep arms of adjacent trays. FIG. 2 also illustrates a motor 42 and a transmission for effecting rotation of the sweep arms 40.

Figure 3:
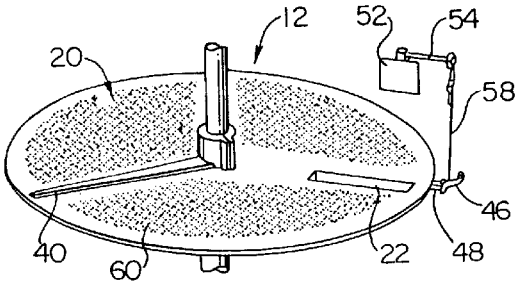
FIG. 3 is a perspective view of a tray in such a desolventizer.

FIG. 3 better illustrates an individual tray apparatus which can be employed to maintain the depth of particulate material on the tray at a desired level. In the case of certain particulate material such as organic grains, it is desirable to maintain a depth of material on each tray at between 16 inches and 48 inches, and approximately 24 inches. To this end, an arrangement can be employed to open a gate 22 in the tray 12, as was discussed hereinbefore, automatically when the depth in the particular plenum exceeds the desired level.

The gate 22 is normally closed to an upper position as has been previously discussed. To maintain the gate 22 in such a position, a crank arm 46, rigidly affixed to the shaft 48 with which the gate 22 pivots, mounts a weight 50 which is dropped to a normal, lower position to maintain the gate 22 closed. The plenum 16 has, mounted therein, a paddle 52 disposed generally at the desired depth level of particulate material within the plenum 16. The paddle 52 is mounted to a shaft 54 which exits the housing 14 and, in turn, is connected to a bell crank 56. As the depth of material in the plenum 16 arises to a point above a desired level, the paddle 52 will be raised, and the shaft 54 to which it is mounted will, in turn, be rotated. This will, commensurately, cause rotation of the bell crank 56. The bell crank 56 mounts, at a distal end thereof, a connecting rod 58. As the bell crank is made to rotate, the connecting rod is drawn upwardly. A remote end of the connecting rod 58 is connected to the crank arm 46 associated with the gate 22. As the connecting rod 58 is drawn upwardly, it overcomes the weight bias and draws the weight 50 upwardly. The gate shaft 48 is then rotated to effect the lowering of the gate 22 to allow the particulate material to be deposited downwardly into the next lower plenum.

Figure 4:
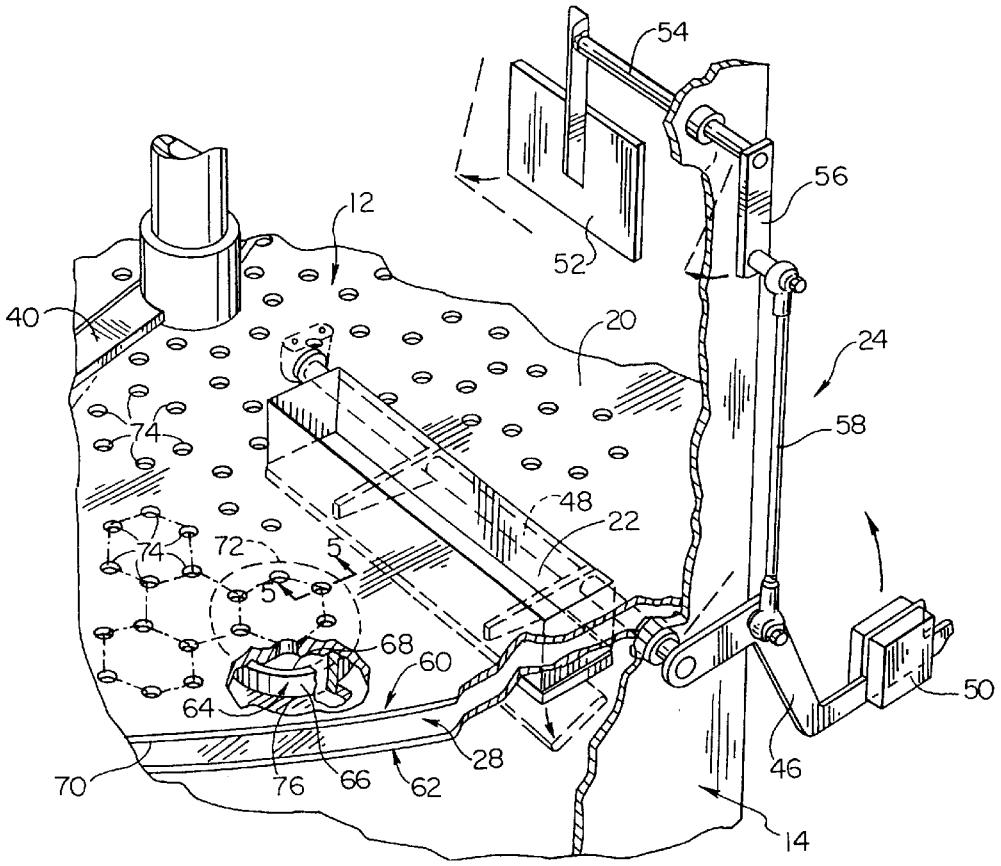
FIG. 4 is an enlarged fragmentary perspective view of a portion of the tray illustrated in FIG. 3.
Figure 5:
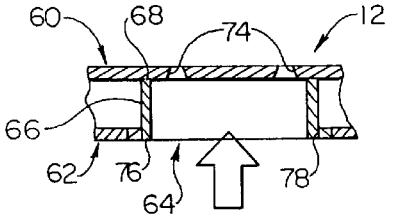
FIG. 5 is a side sectional view illustrating a staybolt in accordance with the construction of the present invention.

FIGS. 4 and 5 illustrate the construction of a particular tray 12 in accordance with the present invention. The tray 12 is defined by a generally planar upper plate 60 and a generally planar lower plate 62 spaced vertically at a distance from each other to define a chamber 28 therebetween. A heating fluid is passed through the chamber 28, as was previously discussed, to effect more efficient processing of the particulate material. The upper and lower plates 60, 62 are spaced from each other at a defined distance by means of a plurality of staybolts 64. Each staybolt 64 has a wall 66 which is shown in FIG. 4 to be generally circular. The axis of the staybolt wall 66 is generally normal to parallel planes defined by the upper and lower plates 60, 62. An upper end 68 of a staybolt 64 is in engagement with a lower surface 70 of the upper plate 60. The staybolt 64 thereby circumscribes a group 72 of associated first apertures 74 formed in the upper plate 60.

A lower end 76 of each staybolt 64 passes through one of a plurality of larger, second apertures 78 formed in the lower plate 62. A conduit 80 passing through the wall 66 of the staybolt 64 provides fluid communication through a tray 12 by interconnecting one of the large second apertures 78 in the lower plate 62 and an associated grouping 72 of first apertures 74 in the upper plate 60. Heated air introduced into a lower plenum can, thereby, pass upwardly through the tray 12 into the plenum immediately above. Passage of such heated air occurs as a result of a pressure differential between the location at which the heated air is introduced into the housing 14 and an egress system 82.

FIG. 5 illustrates the specific construction of a staybolt 64 with respect to the upper and lower plates 60, 62. As previously discussed, an upper, or first, end 68 of the staybolt 64 defines a shoulder which abuts against the lower surface 70 of the upper plate 60. A lower, or second, end 76 of the staybolt 64 is shaped and sized to fit snugly within a corresponding second aperture 78 formed in the lower plate 62. Because of this construction, welding of a staybolt 64 in place can be accomplished easily.

Figure 6:
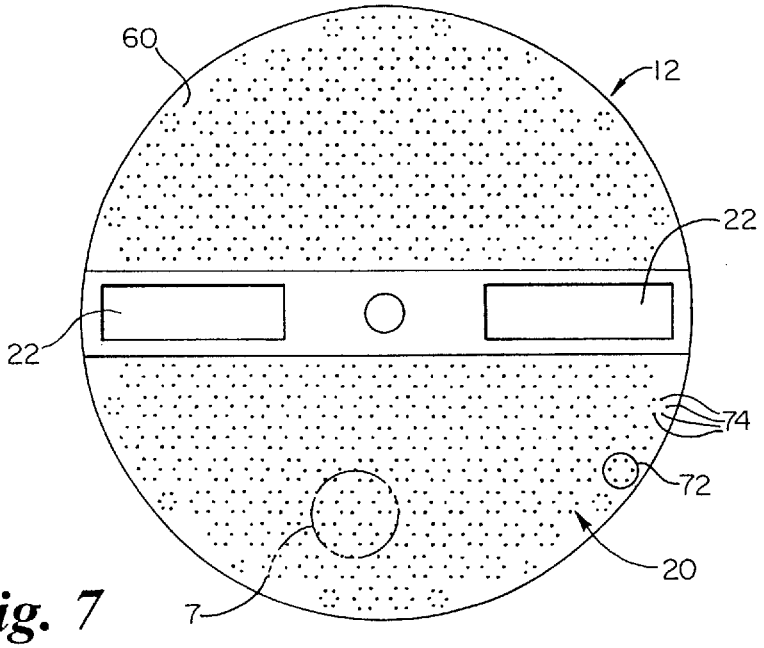
FIG. 6 is a top plan view of a tray in accordance with the present invention.

FIG. 5 also illustrates the construction of first apertures 74 formed in the upper plate 60. As seen in FIG. 5, those apertures 74 are tapered, having a smaller diameter at the upper surface of the upper plate 60 than the diameter at the lower surface 70 of the upper plate 60. This construction serves a number of functions. First, but not exclusively, it inhibits the apertures from becoming occluded by particulate material seated on the tray 12. Because of the expanding diameter in a downward direction, clogging is unlikely. Further, however, because of the decreasing diameter in an upward direction, fluid flow will become accelerated slightly as it passes upwardly through these apertures. With particulate material being seated on the upper surface of the upper plate 60 to a depth of approximately 24 inches, the fluid moving upwardly through the first apertures 74 will have the effect of creating a fluid dome above each first aperture. In order to effect most efficient processing of the granular material, these fluid domes should not intersect one another. In order to accomplish this goal, the first apertures 74, as best seen in FIGS. 4 and 6, are generally uniformly distributed throughout the tray 12. Such a distribution maximizes the processing effects of the apparatus.

Figure 7:
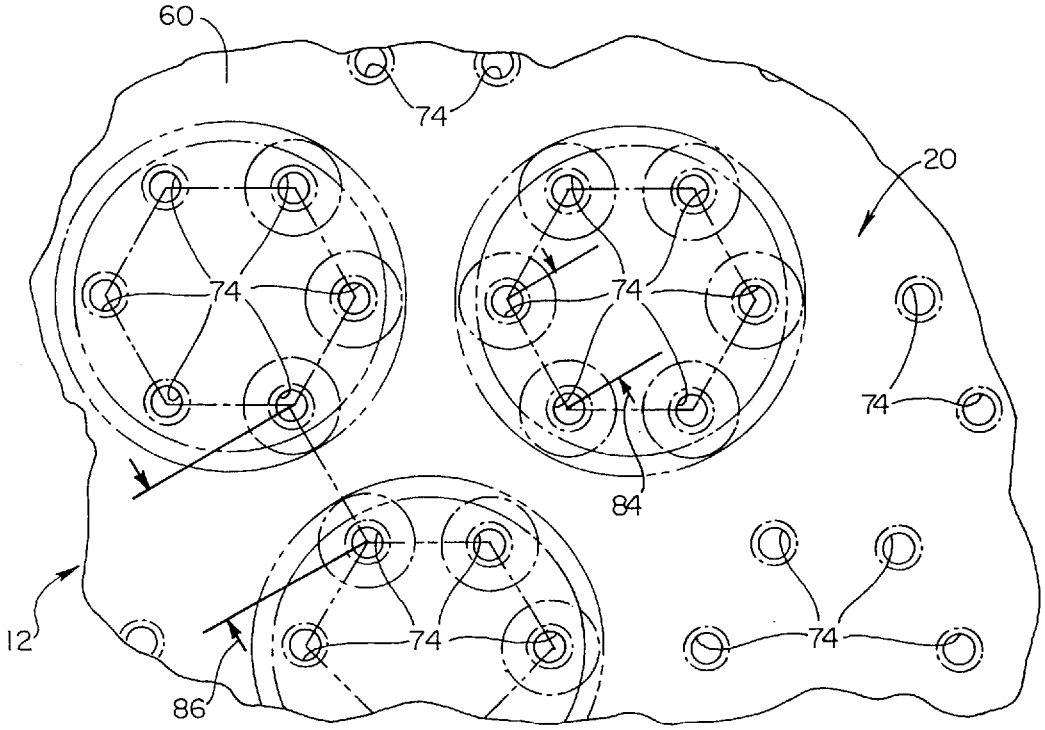
FIG. 7 is an enlarged fragmentary portion of the tray of FIG. 6.

FIGS. 4, 6 and 7 illustrate the intended distribution of the first apertures 74, in a manner in accordance with the present invention. Each associated group 72 of first apertures 74 is shown as defining a hexagonal figure with each of six first apertures of the group being at an interstice of the hexagonal figure.

As best seen in FIG. 7, a staybolt wall 66 circumscribes a hexagonal figure defined by the six associated first apertures. Consequently, the associated second aperture 78 in the lower plate 62 is made to be in fluid communication with the corresponding six first apertures 74, and heated air passing through the second aperture in the lower plate will pass through the conduit defined within the wall 66 of the staybolt 64 and through the corresponding six first apertures in the upper plate 60.

As best seen in FIG. 7 also, while the associated grouping of six first apertures 74 defines a substantially equilateral, equiangular hexagon, two first apertures of one associated grouping of first apertures form, along with two adjacent apertures of each of two adjacent first aperture-associated groups, a hexagonal figure also. In the case of this hexagon, however, not all of the sides are of the same length, and not all of the angles are of the same angular measure. To illustrate, distance 84 between centers of fluid domes 88 generated at two adjacent first apertures of a common associated grouping of first apertures is smaller than distance 86 between centers of fluid domes 88 generated at two adjacent first apertures in different associated groupings. Consequently, various of the angles will differ in angular measure. An optimum size relationship range between distance 86 relative to distance 84 is between 1.75:1 and 1.0:1.

As will be able to be seen then, in view of this disclosure, while pairs of adjacent first apertures from one particular associated group of first apertures combine with a pair of first apertures from each of two adjacent groupings of associated apertures to form a hexagonal figure, that figure, while approximating an equilateral, equiangular hexagon, in fact, define a hexagon which has different sized sides and angles. Nevertheless, a generally uniformly distributed honeycomb matrix of generally uniformly distributed first apertures is formed throughout the upper plate 60 of the tray 12, and passage of heated air through the first apertures 74 will be generally equally distributed into the bed of material above them. As a consequence, fluid domes generated above each first aperture 74 will be similar in size and shape and small enough so that there will not likely be any intersection. As a result, processing of the particulate material is optimized.

It will be understood that, to this point, each tray 12 has been discussed in terms of a single discharge gate 22 formed therein. FIG. 6, however, illustrates a dual gate configuration. In this construction, the first apertures formed in the upper plate of the tray are still distributed throughout the upper plate substantially as discussed hereinbefore.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. In an apparatus for processing particulate material, a tray for generally supporting the material during processing, comprising:

(a) a generally planar upper plate having pluralities of associated groupings of first apertures formed therein;

(b) a generally planar lower plate having a plurality of second apertures formed therein, each of said second apertures corresponding with, and generally underlying, one of said associated groupings of first apertures formed in said upper plate;

(c) a plurality of staybolts intermediate said upper and lower plates, each staybolt having a first end, circumscribing an associated grouping of first apertures, defining a shoulder in engagement with a lower surface of said upper plate, and a second end received through one of said second apertures, each staybolt having a wall with a conduit passing therethrough between said first and second ends of said staybolt to direct fluid, having passed through a corresponding second aperture, through said corresponding associated grouping of first apertures; and (d) wherein spacing and positioning of a first aperture in one associated grouping relative to an adjacent first aperture in an adjacent associated grouping is such that distribution of said first apertures throughout said upper plate is generally uniform.

2. The tray of claim 1 wherein each associated grouping of first apertures includes six apertures.

3. The tray of claim 2 wherein the first apertures of each associated grouping define an equilateral hexagon.

4. The tray of claim 3 wherein each equilateral hexagon is equiangular.

5. The tray of claim 4 wherein said pluralities of associated groupings of first apertures generally define a honeycomb pattern throughout said upper plate.

6. The tray of claim 1 wherein each of said second apertures is circular, having a diameter, and wherein an outer diameter of a wall of each staybolt, at a second end of said staybolt, is the same as a diameter of a corresponding second aperture.

7. A tray for supporting, in a processing apparatus, particulate material to be processed therein, comprising:

(a) a generally planar upper plate having a plurality of associated groupings of six first apertures formed therein;

(b) a generally planar lower plate having a plurality of second apertures formed therein, each of said second apertures corresponding with, and generally underlying, one of said associated groupings of first apertures; and (c) a plurality of staybolts intermediate said upper and lower plates, each of said staybolts corresponding to a second aperture and an associated grouping of first apertures to which said second aperture corresponds, each of said staybolts having a wall with a conduit passing therethrough to interconnect, and provide fluid communication through, a second aperture and the corresponding associated grouping of first apertures;

(d) wherein an associated grouping of six first apertures is positioned closely proximate two adjacent groupings of six first apertures to define a generally honeycomb array.

8. The tray of claim 7 wherein fluid passes through the processing apparatus as a result of a pressure differential, and wherein fluid having passed through a second aperture, a corresponding conduit, and a corresponding associated grouping of first apertures creates a fluid dome in particulate material supported by said upper surface of said upper plate above each of said first apertures.

9. The tray of claim 8 wherein spacing between first apertures of an associated grouping defines a hexagonal pattern which is such that fluid domes generated do not intersect.

10. The tray of claim 9 wherein the first apertures of each associated grouping define a generally equilateral, equiangular hexagon.

11. The tray of claim 10 wherein two first apertures of one associated grouping form, together with two most closely proximate first apertures of each of two adjacent groupings, a hexagon whose sides and angles are not all the same.

12. The tray of claim 11 wherein one first aperture of one associated grouping of first apertures is spaced from an immediately adjacent first aperture of a not her associated grouping of first apertures at a distance greater than that at which two adjacent first apertures within a particular associated grouping of first apertures are spaced from one another.

13. The tray of claim 12 wherein the distance between two adjacent first apertures and different associated groupings and a distance between adjacent first apertures of a common associated grouping is within the range between 1.75:1 and 1.0:1.

* * * * *